US005273325A

United States Patent [19]

Zimmermann

[11] Patent Number: 5,273,325

[45] Date of Patent: Dec. 28, 1993

[54] MOTOR-VEHICLE DOOR LATCH WITH POWER ASSIST

[75] Inventor: Gerhard Zimmermann, Velbert, Fed. Rep. of Germany

[73] Assignee: Kiekert GmbH & Co. KG, Heiligenhaus, Fed. Rep. of Germany

[21] Appl. No.: 8,806

[22] Filed: Jan. 22, 1993

[30] Foreign Application Priority Data

Feb. 20, 1992 [DE] Fed. Rep. of Germany ..... 4205181
Jul. 4, 1992 [DE] Fed. Rep. of Germany ..... 4222051

[51] Int. Cl.[5] ..... E05C 3/16

[52] U.S. Cl. ..... 292/216; 292/DIG. 72; 292/336.3; 292/341.16; 292/DIG. 43

[58] Field of Search ..... 292/216, 280, 341.16, 292/336.3, DIG. 72, DIG. 43, 201

[56] References Cited

U.S. PATENT DOCUMENTS 4,796,932 1/1989 Tame ..... 292/341.16 X
4,982,984 1/1991 Yokota et al. ..... 292/341.16 X
5,118,146 6/1992 Watanuki ..... 292/341.16 X

*Primary Examiner*—Richard E. Moore
*Attorney, Agent, or Firm*—Herbert Dubno; Andrew Wilford

[57] ABSTRACT

A motor-vehicle door latch has a bolt projecting from a support and movable by an actuator between an advanced and a retracted position, and a housing movable between an open, a partially closed, and a fully closed position. A latch fork can engage the door bolt to retain same and lock the door. The servoactuator can, when the bolt is engaged with the fork, move the housing between the partially and fully closed positions. A pawl pivots on the housing between a holding position retaining the fork in the latched position and a freeing position permitting the fork to move out of the latched position. A release lever on the housing displaces the pawl from the holding to the freeing position. A opening lever on the housing operatively engageable with the support is coupled to the pawl for moving it from its locked to its unlocked position on movement of the opening lever from a cocked to a rest position. The opening lever moves on displacement of the housing from the partially to the fully closed position from the rest to the cocked position and on displacement of the housing from the fully to the partially closed position from the cocked to the rest position so that on movement of the bolt from the advanced to the retracted position with the bolt engaged in the fork the opening lever is moved from the rest to the cocked position.

8 Claims, 5 Drawing Sheets

MOTOR-VEHICLE DOOR LATCH WITH POWER ASSIST

FIELD OF THE INVENTION

The present invention relates to a door latch for an automotive vehicle. More particularly this invention concerns such a latch which has a power assist or pull-down that pulls the door from a partly closed to a fully closed position.

BACKGROUND OF THE INVENTION

A standard motor-vehicle door latch has a housing mounted on the door edge and formed with a recess into which is engageable a bolt projecting from the edge of the respective door opening. A fork is pivotal in the housing between a latching position engaging around the bolt and holding it solidly in the recess and a freeing position permitting the bolt to enter and leave the recess. A latch pawl engageable with the fork can retain it in the latched position. The latch pawl in turn is controlled via appropriate levers which can therefore operate the latch to allow the door to be opened. When the latch is used on a side door, inside and outside actuating mechanisms are provided, and when on a trunk or hatch, an inside release and outside lock cylinder can operate the pawl.

In a power-assist system the bolt is movable between end positions perpendicular to the closing and opening direction of the respective door (which term is here intended to cover a trunk lid or hatch). Thus once the pawl engages around the bolt the door is in a partially closed position and subsequent inward movement of the bolt pulls this partly closed door into the fully closed position.

A thus equipped door is opened manually simply by actuating the appropriate mechanism to pull back the latch pawl. If, however, it is desired to open the door electrically, as is for instance convenient with a trunk latch, there are substantial problems. The fact that the servoactuator that moves the door bolt between its end positions is located in the door post or at the edge of the door opening and the latch pawl is in the latch itself which is mounted on the door requires that a separate actuator be provided in order to have power-assisted opening of the latch in addition to power-assisted closing.

OBJECTS OF THE INVENTION

It is therefore an object of the present invention to provide an improved power-assist motor-vehicle door latch.

Another object is the provision of such an improved power-assist motor-vehicle door latch which overcomes the above-given disadvantages, that is which only needs a single servo-actuator but that has power-assisted closing and opening.

SUMMARY OF THE INVENTION

A motor-vehicle door latch has according to the invention a support, a door bolt projecting from the support and movable in a direction thereon between an advanced end position and a retracted end position, and a housing movable relative to the support in the direction for opening and closing of a door between a fully open position spaced relatively far from the support, a partially closed position spaced relatively closely to the support, and a fully closed position snugly engaging the support. A latch fork pivotal on the housing about a latch-fork axis is engageable in a latched position with the door bolt to retain same and lock the door. A servo-actuator connected to the door bolt can move it between its advanced and retracted positions and can simultaneously, when the bolt is engaged with the fork, move the housing between the respective partially closed position and the respective fully closed position. A pawl can pivot on the housing between a holding position retaining the fork in the latched position and a freeing position permitting the fork to move out of the latched position. A release lever on the housing coupled to the pawl is operable to displace it from the holding to the freeing position and an opening lever on the housing operatively engageable with the support is displaceable between a cocked and a rest position. The opening lever is coupled to the pawl for moving the pawl from its locked to its unlocked position on movement of the opening lever from the cocked to the rest position and for moving the opening lever on displacement of the housing from the partially closed position to the fully closed position from the rest position to the cocked position and on displacement of the housing from the fully closed to the partially closed position from the cocked to the rest position so that on movement of the bolt from the advanced to the retracted position with the bolt engaged in the fork the opening lever is moved from the rest to the cocked position. A spring urges the opening lever into the rest position.

Thus with this system the opening lever is cocked when the latch is fully closed. When subsequently the latch is moved by the actuator into the partially closed position, the stored-up force in the opening lever serves to trip the release pawl and open the latch. No second actuator is needed for power opening of the door.

The bolt according to the invention is basically cylindrical and is orbitable about an axis between its advanced and retracted positions. The actuator includes an electric motor operatively connected to the bolt.

In accordance with this invention the opening lever is pivotal on the housing and has one arm angularly engageable with the support and another arm connected to the coupler. The spring is a torque spring engaged between the opening lever and the housing. The fork is provided with an eccentric link pin and the latch further has a coupling lever engageable with the eccentric link pin and displaceable between one end position corresponding to the latched position of the fork and another end position corresponding to an open position of the fork permitting movement of the bolt into and out of the housing. The coupler includes a release lever displaceable by the coupling lever between a release position coupled to the pawl and capable of operating same and a freeing position decoupled from the pawl. The housing is provided with a pivot pin and the release lever has an elongated slot fitting over the pivot pin. The release lever is slidable along the pin on movement between its release and freeing positions. Furthermore the holding lever has a surface operatively engaging the release lever and extending at an acute angle to the slot in the rest position of the holding lever and generally parallel to the slot in the cocked position. A spring urges the release lever into the release position and the holding lever and pawl are also pivoted on the pin.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
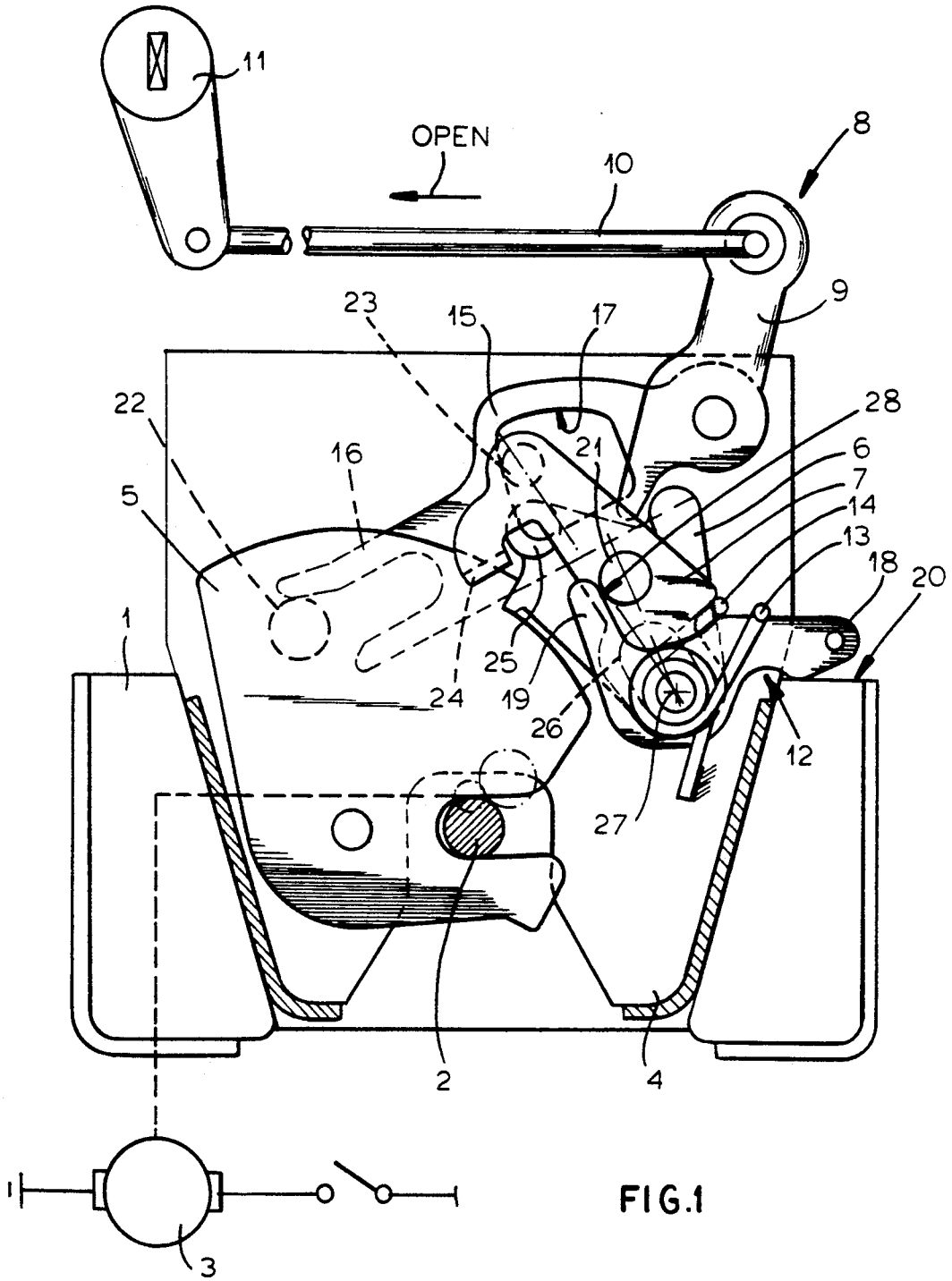
FIG. 1 is a side sectional view through the latch according to this invention in the fully closed position.
Figure 2:
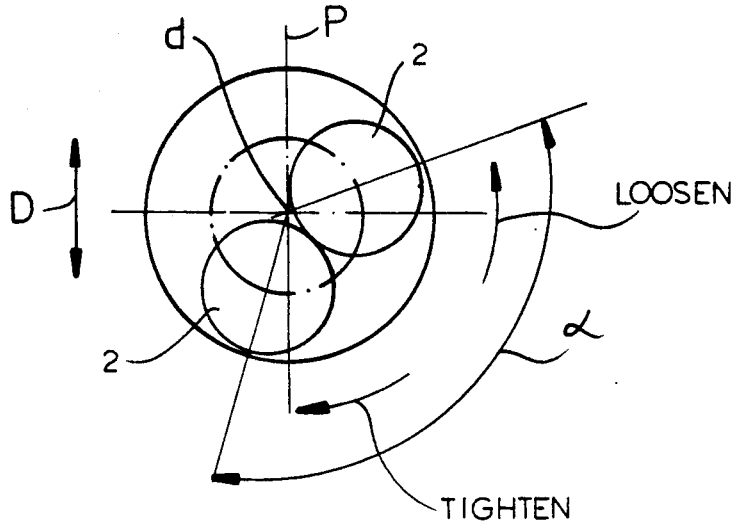
FIG. 2 is a diagram illustrating movement of the door bolt between the fully and partly closed positions.

As seen in FIGS. 1 through 4 a latch according to the invention basically has a bolt housing 1 normally mounted on a door post or door-opening edge and carrying a bolt 2 orbitable limitedly about a center d between the end positions shown in solid lines in FIG. 2, which are offset relative to each other in an opening direction D of the system. An electric servoactuator 3, here constituted as a motor and a switch, and possibly also of stepdown gearing, is connected to the bolt 2 for such movement.

A latch housing 4 that can fit complementary into a recess of the bolt housing 1 is provided as is standard in the art with a pivotal latch fork 5 that can engage around and trap the bolt 2 against movement in the direction D relative to the housing 4. A latch pawl 6 that is also of standard construction can engage and block the fork 5 in the locking or retaining position shown in FIGS. 1, 4, and 6 or can move into the freeing position of FIGS. 4 and 5 and allow the fork 5 to pivot out of the locking position. The fork 5 can in fact have several shoulders that coact with the pawl 6 to retain the bolt 2 in intermediate positions, but such are not significant for the invention and, in fact in the illustrated trunk latch, are not needed.

Furthermore as is standard in the art a lever system 8 can act on and displace the latch pawl 7 into the release position. In the illustrated trunk latch, this system 8 comprises a lever 9 that can act directly on the pawl 7, a rod 10 connected to the lever 9, and a cylinder 11 connected to the rod 10 and operable to shift it to release the pawl 7. In a side-door latch inside and outside operating mechanisms would be provided.

Figure 4:
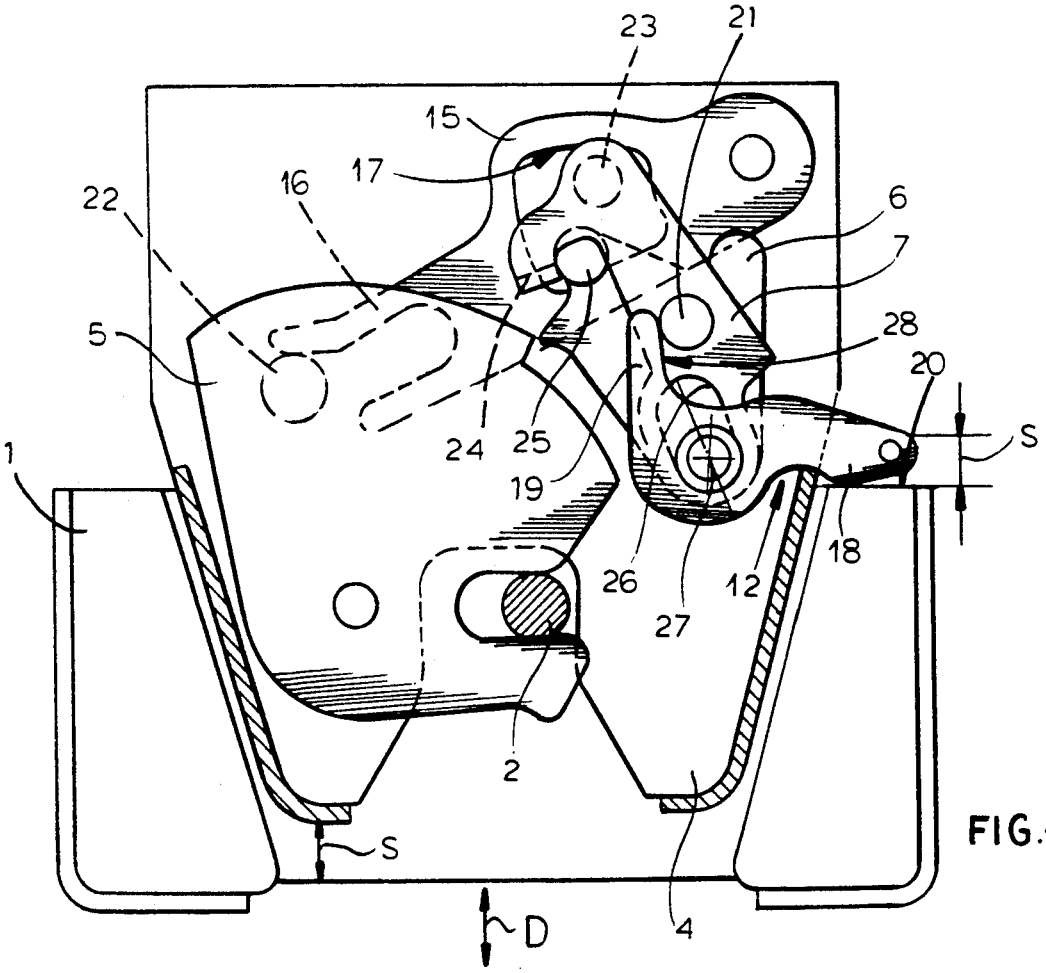
FIG. 4 is a view like FIG. 1 of the latch in the partly closed position while moving into the open position.
Figure 3:
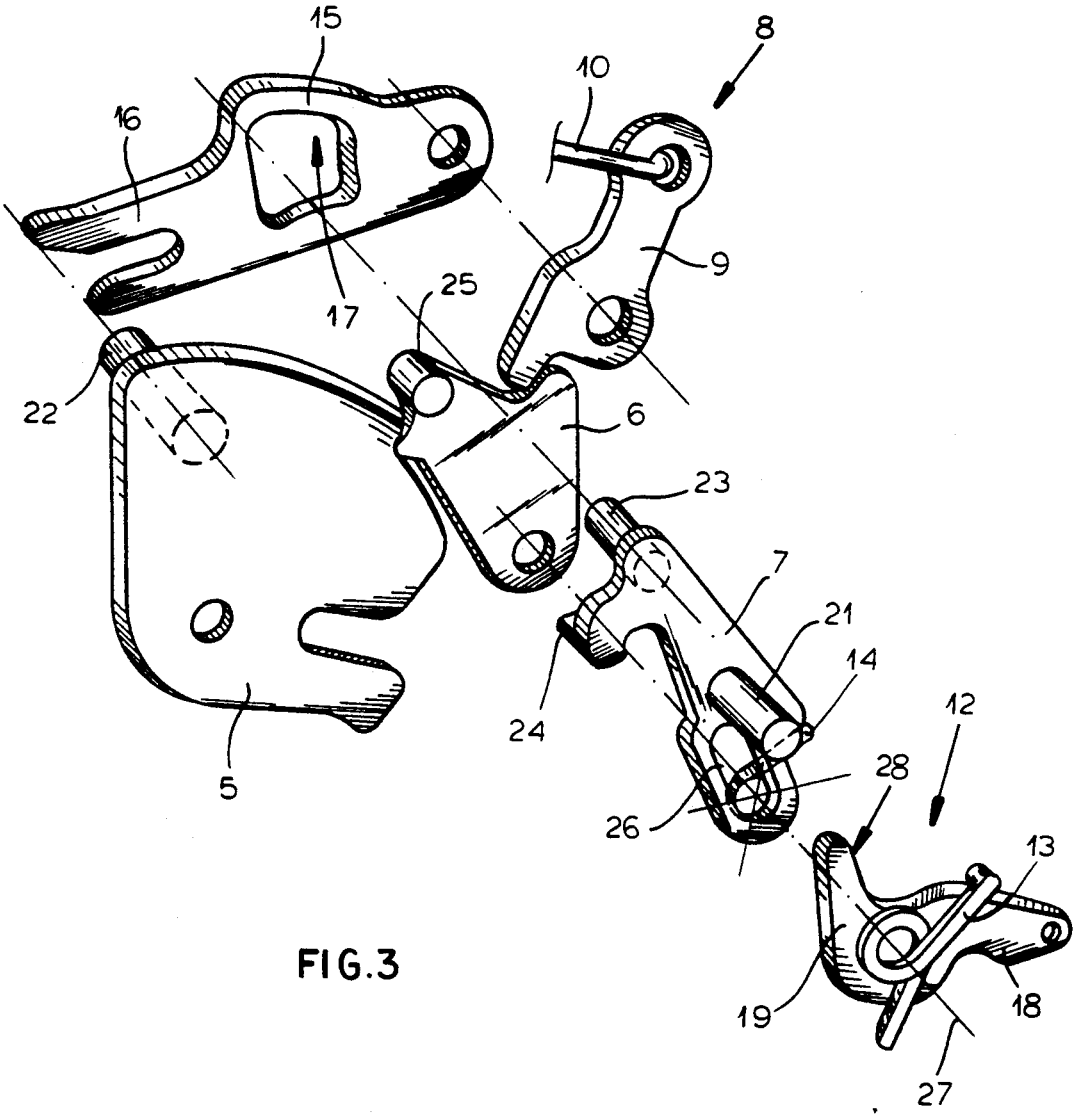
FIG. 3 is an exploded view of the principal parts of the latch.
Figure 6:
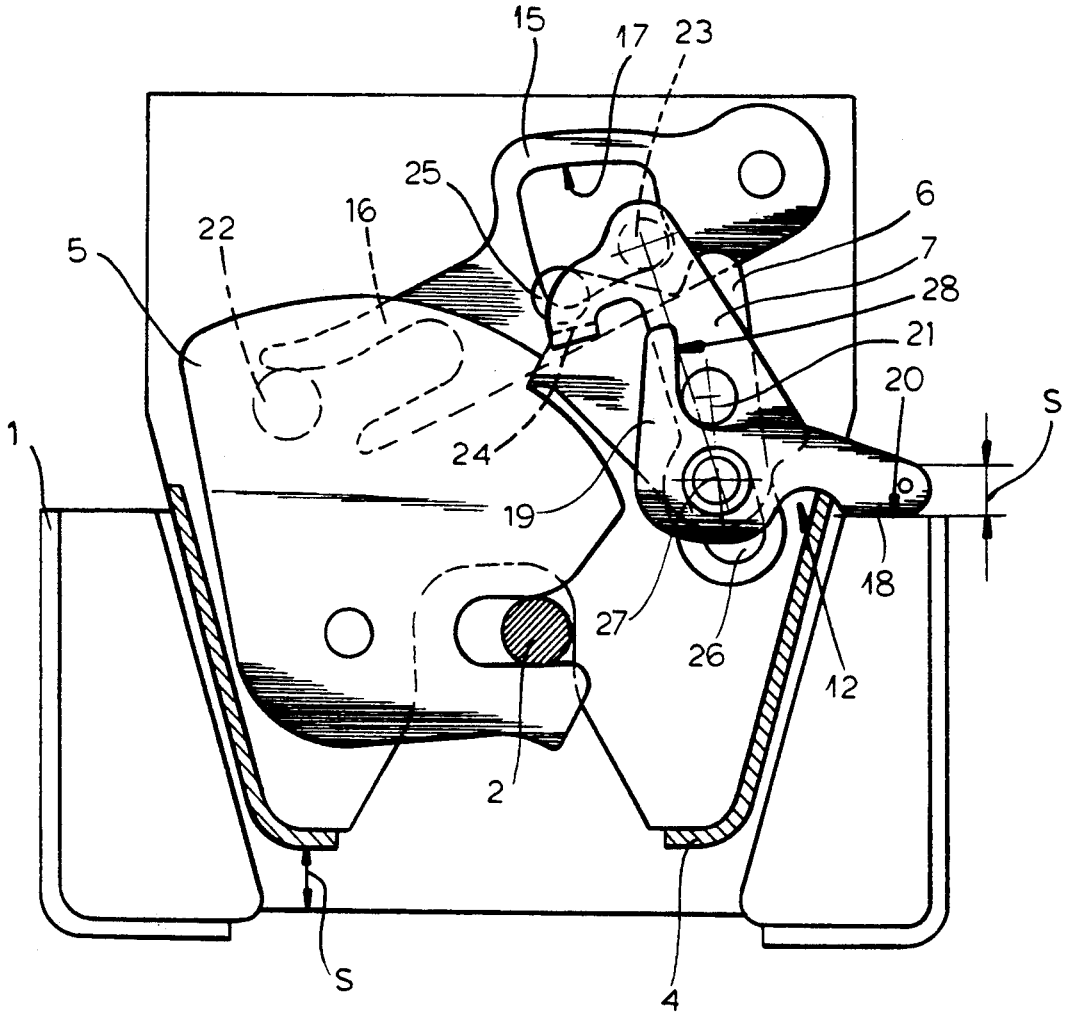
FIG. 6 is a view like FIG. 1 of the latch in the partly closed position while moving into the fully closed position.

Thus as is standard in the art, once the bolt 2 is engaged in the fork 5 and same is pivoted around to the position of FIG. 1, 4, or 6, the actuator 3 can pivot the bolt 2 through an angle $\alpha$ of less than 180° in a rotary tightening sense to shift the bolt 2 in the direction D through a stroke S, thereby pulling the housing 4 snugly into the housing 1 as shown in FIG. 1. The ending position of the bolt 2 when fully tightened to its ending position is located relative to the direction D such that the bolt 2 will hold in this position, since once it passes a plane P parallel to the direction D, force backward in the direction D will not move it back in the loosening direction into the starting position.

In addition an opening lever 12 having a pair of arms 18 and 19 is pivoted on a pin 27 in the housing 4 and is continuously urged counterclockwise as seen in the drawing by a torque spring 13. A release lever 7 is provided on one side with an actuating pin 21 that is engageable with a surface 28 of the arm 19 and has on its other side another pin 23 that engages in a guide window 17 of a coupling lever 15 also pivoted on the housing 4 and having a forked outer end 16 engaged over an eccentric pin 22 on the fork 5. The release lever 7 has an actuating tab 24 angularly engageable with an actuating pin 25 on the release pawl 6 and is formed with an elongated slot 26 that fits over the pin 27. Thus this lever 7 is slidable on the pin 27 between a release position shown in FIGS. 1 and 4 with the actuating formations 24 and 25 angularly engageable with each other on pivoting of the lever 7 clockwise on the pin 27 and a freeing position shown in FIGS. 5 and 6 not thus angularly engageable with each other. A spring 14 continuously biases the lever 7 toward the release position with the formations 24 and 25 aligned angularly with each other. The arm 18 of the lever 12 is engageable with an abutment surface 20 on the housing 1 for pivoting or cocking of the lever 12 on closing of the latch as described below.

The latch described above operates as follows:

In the fully closed position of FIG. 1 the housing 4 fits snugly in the housing 1 and the surface 20 engages the arm 18 to pivot the lever 12 somewhat counterclockwise, aligning the surface 28 generally with the slot 26 of the lever 7 so that the pin 21 will slide down on the surface 28 because the spring 14 is pulling the entire lever 7 into the release position. Meanwhile the latch pawl 6 is hooked on the shoulder of the fork 5 to retain it in place and the formations 24 and 25 are angularly aligned with each other.

Starting from this position, if the actuator 3 pivots the bolt 2 through its angle $\alpha$ in the loosening direction (see FIG. 2), the housings 1 and 4 will separate by the stroke S. This action will allow the lever 12 to pivot clockwise somewhat, in the direction it is biased in by its spring 13. Thus the arm 19 of the lever 12 will press the pin 21 of the lever 7, pivoting the lever 7 also clockwise, and the tab 24 of this lever 7 will press angularly against the pin 25 of the pawl 6, thereby pulling the pawl 6 into the freeing position as seen in FIG. 4. The spring force stored up in the lever 12 during closing of the latch therefore is used on partial opening to trip the pawl 6 and open the latch.

Figure 5:
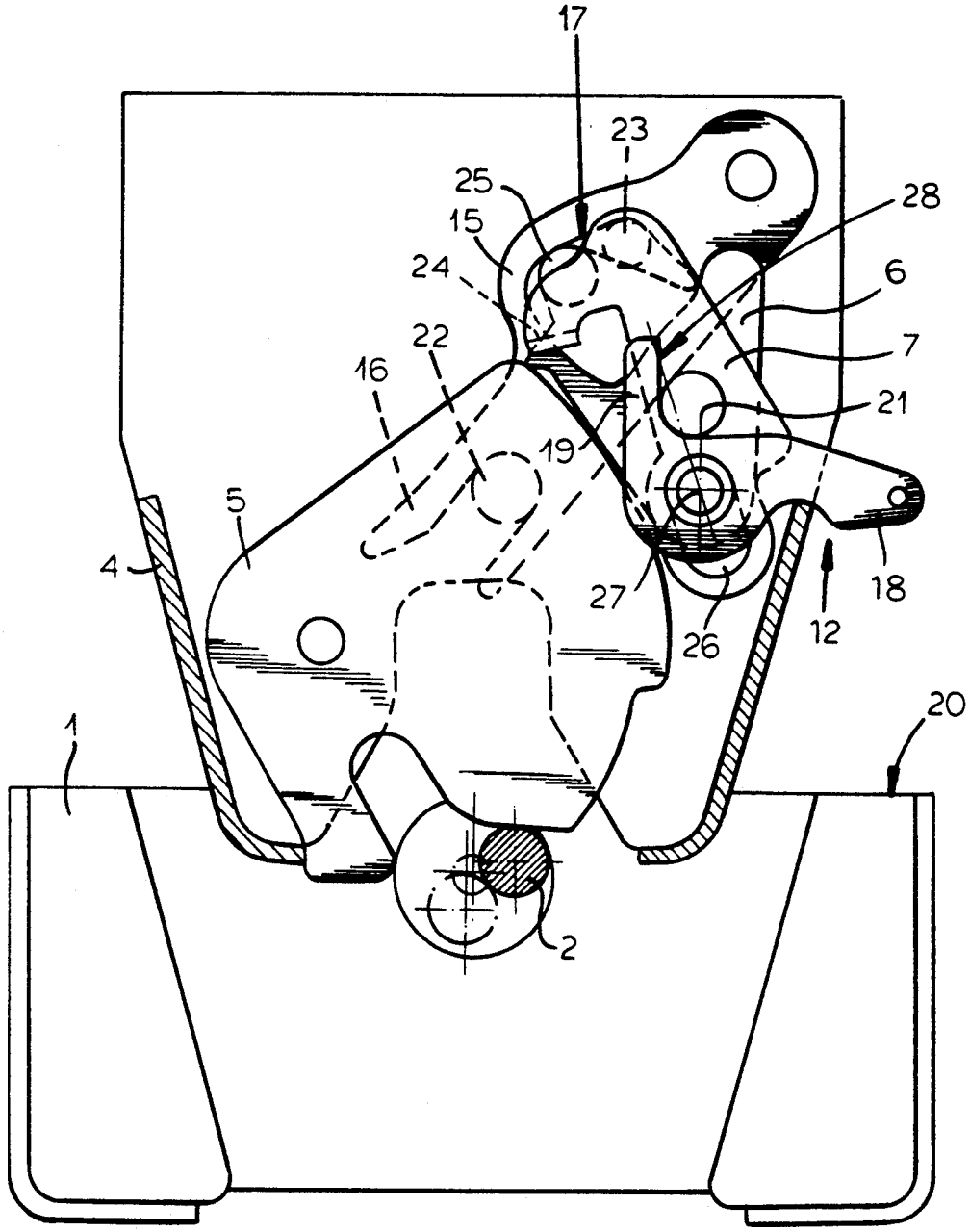
FIG. 5 is a view like FIG. 1 of the latch in the open position.

Thus, as seen in FIG. 5, the latch moves into the open position. As the latch opens the coupling lever 15 is pivoted counterclockwise so its guide window 17 presses the pin 23 and lever 7 downward, thereby shifting the lever 7 inward against the force of its spring 14, but in this position the surface 28 extends at an acute angle to the slot 26 so that the force of the spring 14 is not enough in itself to allow this lever 7 to move back out into the release position, even if the lever 15 permitted such movement.

On subsequent partial closing of the door as seen in FIG. 6, the fork 5 is pivoted back into the holding position and the pawl 6 snaps back under the force of an unillustrated return spring. The lever 12 in this position has just barely made contact with the surface 20, but has not been pivoted enough to allow the spring 14 to push the lever 7 back out into the outer release position. Incidentally if power fails in this position, a manual release connected to the hole in the end of the arm 18 allows the door to be opened manually from inside the vehicle. In the fully closed position only the outside release cylinder 11 is effective.

When thereafter the actuator 3 shifts the bolt 2 angularly to pull the housings 1 and 4 together through the stroke S, this action will pivot the lever 12 counterclockwise. As the surface 28 aligns itself with the slot 26, the spring 14 will be able to push the lever 7 back out into the release position, thereby rearming the system and returning the latch to the position of FIG. 1. Meanwhile, however, the levers 7 and 12 will have pivoted enough that the tab 24 will have moved counterclockwise past the pin 24 before the lever 7 moves out into the release position.

Thus as the power pulldown moves the door from the partially closed to the fully closed position, energy is stored up by the spring 13 in the lever 12. When subsequently the power pulldown moves the door back into the partially open position, this stored-up energy is used to trip the pawl 6 into the release position.

I claim:

1. A motor-vehicle door latch comprising:

a support;

a door bolt projecting from the support and movable in a direction thereon between an advanced end position and a retracted end position;

a housing movable relative to the support in the direction for opening and closing of a door between a fully open position spaced relatively far from the support, a partially closed position spaced relatively closely to the support, and a fully closed position snugly engaging the support;

a latch fork pivotal on the housing about a latch-fork axis and engageable in a latched position with the door bolt to retain same and lock the door;

means including a servoactuator connected to the door bolt for moving it between its advanced and retracted positions and for simultaneously, when the bolt is engaged with the fork, moving the housing between the respective partially closed position and the respective fully closed position;

a pawl pivotal on the housing between a holding position retaining the fork in the latched position and a freeing position permitting the fork to move out of the latched position;

a release lever on the housing coupled to the pawl and operable to displace it from the holding to the freeing position;

an opening lever on the housing operatively engageable with the support, displaceable between a cocked and a rest position;

means coupling the opening lever to the pawl for moving the pawl from its locked to its unlocked position on movement of the opening lever from the cocked to the rest position and for moving the opening lever on displacement of the housing from the partially closed position to the fully closed position from the rest position to the cocked position and on displacement of the housing from the fully closed to the partially closed position from the cocked to the rest position, whereby on movement of the bolt from the advanced to the retracted position with the bolt engaged in the fork the opening lever is moved from the rest to the cocked position; and spring means urging the opening lever into the rest position.

2. The motor-vehicle door latch defined in claim 1 wherein the bolt is basically cylindrical and is orbitable about an axis between its advanced and retracted positions, the actuator including an electric motor operatively connected to the bolt.

3. The motor-vehicle door latch defined in claim 1 wherein the opening lever is pivotal on the housing has one arm angularly engageable with the support and another arm connected to the coupling means, the spring means being a torque spring engaged between the opening lever and the housing.

4. The motor-vehicle door latch defined in claim 1 wherein the fork is provided with an eccentric link pin, the latch further comprising a coupling lever engageable with the eccentric link pin and displaceable between one end position corresponding to the latched position of the fork and another end position corresponding to an open position of the fork permitting movement of the bolt into and out of the housing, the coupling means including a release lever displaceable by the coupling lever between a release position coupled to the pawl and capable of operating same and a freeing position decoupled from the pawl.

5. The motor-vehicle door latch defined in claim 4 wherein the housing is provided with a pivot pin and the release lever has an elongated slot fitting over the pivot pin, the release lever being slidable along the pin on movement between its release and freeing positions.

6. The motor-vehicle door latch defined in claim 5 wherein the holding lever has a surface operatively engaging the release lever and extending at an acute angle to the slot in the rest position of the holding lever and generally parallel to the slot in the cocked position.

7. The motor-vehicle door latch defined in claim 5, further comprising spring means urging the release lever into the release position.

8. The motor-vehicle door latch defined in claim 5 wherein the holding lever and pawl are also pivoted on the pin.

* * * * *